US009689192B2

(12) United States Patent
Iglesias Ballester

(10) Patent No.: US 9,689,192 B2
(45) Date of Patent: Jun. 27, 2017

(54) CLOSING SYSTEM FOR THROUGH OPENINGS

(71) Applicant: AMISERRU, S.L., Sant Cugat del Vallés (ES)

(72) Inventor: Miguel Angel Iglesias Ballester, Sant Cugat del Vallés (ES)

(73) Assignee: AMISERRU, S.L., Sant Cugat del Vallés (ES)

( * ) Notice: Subject to any disclaimer, the term of this patent is extended or adjusted under 35 U.S.C. 154(b) by 0 days.

(21) Appl. No.: 14/895,116

(22) PCT Filed: Jun. 4, 2013

(86) PCT No.: PCT/ES2013/070356
§ 371 (c)(1),
(2) Date: Dec. 1, 2015

(87) PCT Pub. No.: WO2014/195523
PCT Pub. Date: Dec. 11, 2014

(65) Prior Publication Data

US 2016/0102489 A1 Apr. 14, 2016

(51) Int. Cl.

| | |
|---|---|
| ***E05F 15/72*** | (2015.01) |
| ***E06B 9/13*** | (2006.01) |
| ***E05D 15/16*** | (2006.01) |
| ***E06B 9/58*** | (2006.01) |
| ***E05F 15/60*** | (2015.01) |
| ***E05D 15/06*** | (2006.01) |
| ***E06B 3/46*** | (2006.01) |

(Continued)

(52) U.S. Cl.
CPC ..... *E05F 15/72* (2015.01); *E05D 15/06* (2013.01); *E05D 15/16* (2013.01); *E05F 15/60* (2015.01); *E05F 15/632* (2015.01); *E06B 3/4645* (2013.01); *E06B 5/16* (2013.01); *E06B 9/13* (2013.01); *E06B 9/58* (2013.01); *E05Y 2900/00* (2013.01); *E05Y 2900/106* (2013.01); *E05Y 2900/134* (2013.01); *E06B 3/362* (2013.01); *E06B 9/68* (2013.01); *E06B 2009/587* (2013.01)

(58) Field of Classification Search
CPC E05F 15/06; E05F 15/60; E05F 15/72; E06B 3/4645; E06B 5/16
USPC ..... 160/98
See application file for complete search history.

(56) References Cited

U.S. PATENT DOCUMENTS

| | | | |
|---|---|---|---|
| 4,819,378 | A | 4/1989 | Ando |
| 2003/0188837 | A1 | 10/2003 | Varley |

(Continued)

FOREIGN PATENT DOCUMENTS

| | | |
|---|---|---|
| DE | 102010024821 | 1/2012 |
| ES | 2166246 | 4/2002 |

(Continued)

*Primary Examiner* — David Purol
(74) *Attorney, Agent, or Firm* — Hodgson Russ LLP

(57) ABSTRACT

The present application refers to a closing system for through openings, comprising a quick opening door provided with a vertically moveable flexible panel, running between a pair of vertical guides and being attached by its upper end to a motor driven drum for its actuation, the system having in combination with the quick opening door a fire door mounted with capacity to move between an opening position and closing position, being the quick opening door and the fire door arranged for its alternate actuation.

8 Claims, 8 Drawing Sheets

(51) Int. Cl.

| | |
|---|---|
| ***E06B 5/16*** | (2006.01) |
| ***E05F 15/632*** | (2015.01) |
| *E06B 9/68* | (2006.01) |
| *E06B 3/36* | (2006.01) |

(56) References Cited

U.S. PATENT DOCUMENTS

| | | | | |
|---|---|---|---|---|
| 2007/0277941 | A1 | 12/2007 | Jansen | |
| 2009/0025886 | A1* | 1/2009 | Crider | E05D 15/54 49/13 |
| 2010/0243175 | A1* | 9/2010 | Gonzales | A62C 2/10 160/7 |
| 2013/0133843 | A1* | 5/2013 | Kraeutler | E06B 9/0692 160/188 |
| 2015/0128496 | A1* | 5/2015 | Phillips | E05D 15/54 49/13 |

FOREIGN PATENT DOCUMENTS

| | | |
|---|---|---|
| FR | 2617230 | 12/1988 |
| FR | 2747182 | 10/1997 |

* cited by examiner

CLOSING SYSTEM FOR THROUGH OPENINGS

FIELD OF THE INVENTION

The invention is applicable to the field of manufacturing industrial doors for through openings.

BACKGROUND OF THE INVENTION

Quick opening doors are widely known in the market, being provided with a perimetric frame and a pair of vertical guides on which a flexible panel may be vertically moved, which panel is attached by its upper end to a motor driven actuation drum.

These types of quick opening doors of this type are arranged at one of the sides of the wall or surface in which the through opening is defined.

In this type of quick opening doors is also usual for the flexible panel to have in its lower end a bag or thickening portion with a bigger size than said panel and, containing a heavy material suitable to facilitate the quick descent of the said panel towards a closing lower position.

Taking into account the materials stored in the rooms communicated by the through opening it may be necessary to install a fire door to permit the separation of one room in relation to the other in case of fire.

Currently, fire doors are known which are mounted on means permitting its offset arrangement in respect to the through opening or in opposition to the same, forming said fire door a perimetric closure on a fixed frame. The problem which arises is that this type of fire doors is not compatible with quick opening doors, as the guides and the frame of the quick opening door prevent the fire door to reach an effective closing position if they are mounted in the same side of the wall.

One eventual solution, which is similar to the solution used in the closing system for cold storage chambers described in document PCT/ES00/00038 of the same applicant, but using a fire door instead of a cold chamber door, would consist in the arrangement of the closing surface of the cold chamber door on a protruding plane which is parallel to the plane of movement of the flexible panel of the quick opening door. However, this solution would not be effective as heat and flames run in an ascending direction so that they would escape through the opening defined in the upper area of the frame for the passage of the flexible panel of the quick opening door.

Therefore, the technical problem to be addressed is the development of a system for closing the through openings permitting to combine a quick opening door with a fire door, so that both may function in a selective and alternate way, using in normal conditions the quick opening door to carry out the opening and closing of the through opening and using the fire door for the closing of the through opening in case of fire.

DESCRIPTION OF THE INVENTION

The closing system for through openings which is the object of the invention is formed by the combination of a quick opening door for normal use and a fire door for an alternate operation, having features aimed at permitting its functional combination, preventing the quick opening door to be a hindrance during the closing operation of the fire door and also to guarantee that the fire door can carry out the effective sealing of the through opening in case of fire.

The system is comprised of a quick opening door having a vertically moveable flexible panel, which runs on a pair of vertical guides, being attached at its upper end to a motor driven drum for its actuation; and, in combination with said quick opening door, a fire door mounted with possibility of moving between an opening position and a closing position in which the through opening is tightly closed.

The system of the invention has particular characteristics aimed at permitting a suitable closing of the through opening by means of the fire door in case of fire and to prevent said fire door to interfere with the vertical guides of the quick opening door.

According to the invention, the vertical guides for the quick opening door have a fixed lower part extending to the height of the through opening and an upper moveable part, located above the through opening and vertically moveable between a lower position in which it is close to the fixed lower part and an upper position in which said upper moveable part is arranged to a certain distance from the fixed lower part, defining between both parts, that is, said upper part and the lower part, an opening for the arrangement of suitable means to establish on the through opening the closing of the space between the wall and the fire door when this latter is arranged in its closing position.

According to the invention, the upper moveable part of the frame and the guides for the quick opening door have abutment elements suitable for its upwards haulage towards the upper position by means of a bag or thickening secured to the lower end to the flexible panel and which is thicker than said flexible panel.

Said bag or thickening may consist in the bag currently used in this type of quick opening doors for the arrangement of a heavy material to facilitate the quick descent of the door toward its closing position.

According to the invention, the system has actuation means connected to a fire alarm system, scheduled to carry out a normal opening of the quick opening door up to the maximum height of the through opening, keeping the fire door opened, or alternatively carrying out an emergency opening providing an over-opening of the quick opening door, surpassing the height of the through opening and provoking the haulage of the upper moveable part of the frame and the guides towards the upper area and provoking at the same time the closing of the fire door.

These features of the quick opening door, allow the establishment of an effective closing against fire in the area located above the through opening when the upper moveable part of the guides is upwardly displaced independently of the use of a sliding fire door or a swiveling fire door.

In this connection and according to an embodiment of the invention, the fire door is of sliding type and it is mounted on a horizontal guide having the possibility to move between an opening position, in which the door is laterally offset in respect of the through opening and a position which closes said through opening; said fire door having in its upper part a lateral extension directed towards the wall or surface in which the through opening is defined, being said lateral extension suitable to be housed laterally in the opening defined between the fixed lower part and the moveable upper part of the vertical guides, establishing on the through opening the closing of the space comprised between the wall and the fire door when the upper moveable part of the guides is offset towards the upper area and said fire door is arranged in its closing position.

The profile in form of an inverted "L" of the fire door, defined by the door itself and the lateral extension, permits the fire door to carry out an effective closing on the fixed vertical struts arranged on the external side elements of the frame for the quick opening door and above the through opening, without the guides or the frame of the quick opening door representing any hindrance.

The invention provides that the system may be automatically driven, so that both the movement of the quick opening door and that of the fire door be motor driven.

In a variant of the invention, the fire door has one or two leaves swiveling on struts secured to each of the vertical guides of the quick opening door. In this case, the moveable upper part of the vertical guides of the quick opening door has a part assembled on a shaft or hinge having the possibility of swiveling between a neutral vertical position and a horizontal operative position, in which position said part establishes on the through opening the closing of the space comprised between the wall and the leaves of the fire door when said fire door is arranged in this closing position.

DESCRIPTION OF THE DRAWINGS

To complete the description and with the aim to facilitate the understanding of the characteristics of the invention, a set of drawings is annexed to the present description, in which in an illustrative but no limitative manner, the following has been shown.

PREFERRED EMBODIMENT OF THE INVENTION

Figure 1:
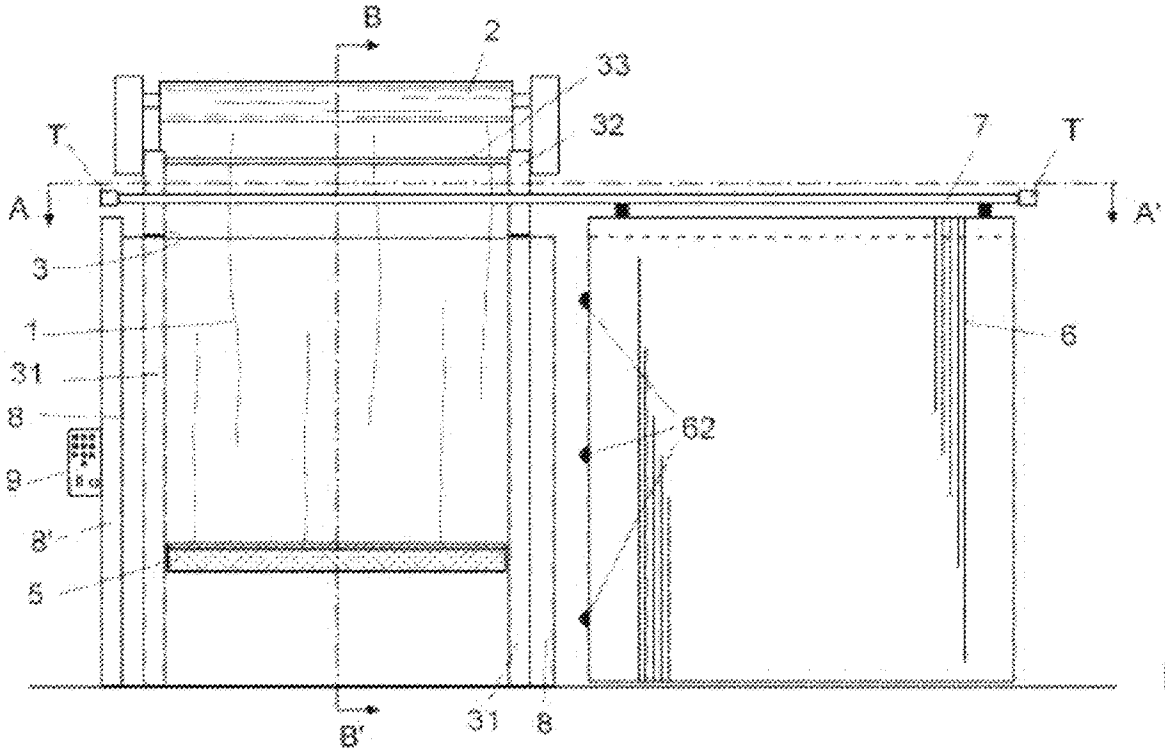
FIG. 1 shows a front view of an embodiment example of the system for closing a through opening according to the invention, in which the quick opening door has been shown in an intermediate opening position and the fire door has been shown in an open position. The Figure shows diagrammatically, by means of a control panel, the means for driving the system.
Figure 2:
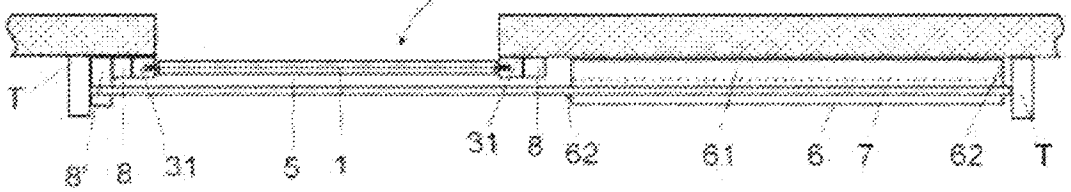
FIG. 2 shows a top view of the closing system sectioned along the plane A-A' as shown in FIG. 1.

In the example of embodiment shown in FIGS. 1 to 9, the system for closing through openings has a quick opening door provided with a vertically moveable flexible panel (1), connected to a motor driven drum (2) and assembled on a pair of vertical guides (3), comprising a fixed lower part (31) and a moveable upper part (32), being the lower parts (31) of the guides respectively arranged on each of the sides of a through opening (H) as shown in FIG. 2, reaching the total height of said opening, while the upper moveable part (32) is located above the opening, having two abutment elements (33), formed in this case by two parallel bars on which runs the flexible panel (1) of the quick opening door.

The flexible panel (1) has in his lower end a bag (5) containing a heavy element (51) to facilitate the descent of the flexible panel in the operation of closing the quick opening door.

Figure 3:
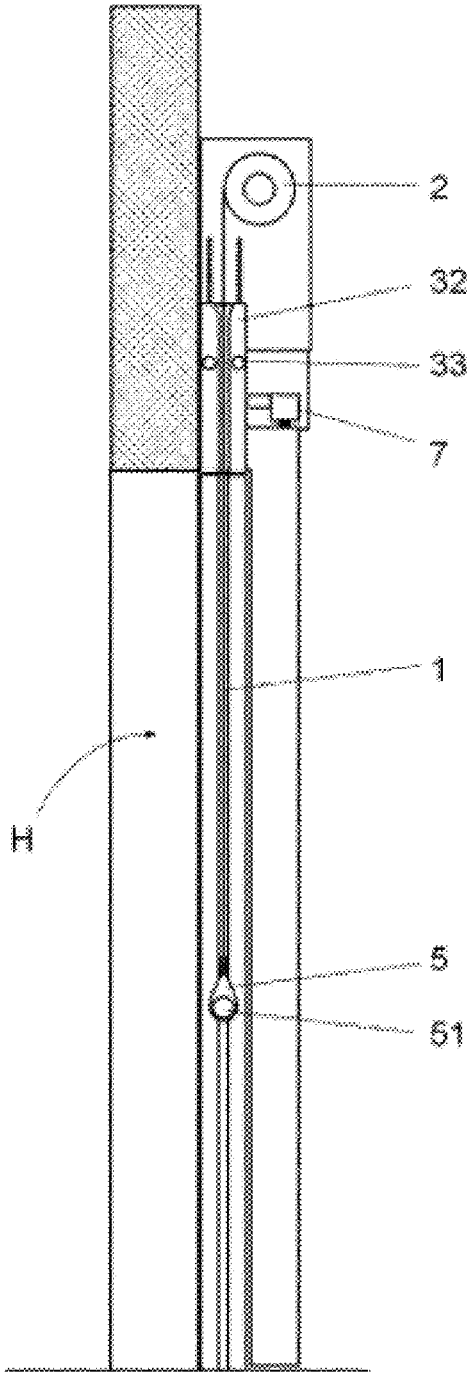
FIG. 3 shows a side view of the closing system sectioned along a vertical plane B-B' as shown in FIG. 1.

As can be observed in FIG. 3, said bag (5) is thicker than the flexible panel (1) and thicker than the through opening defined between the abutments (33) linking the two upper portions (32) of the vertical guides (3) of the quick opening door. During normal operation (that is, without emergency) the quick opening door performs successive opening and closing movements and its lower end reaches in the opening position the maximum height (H) of the through opening.

Figure 7:
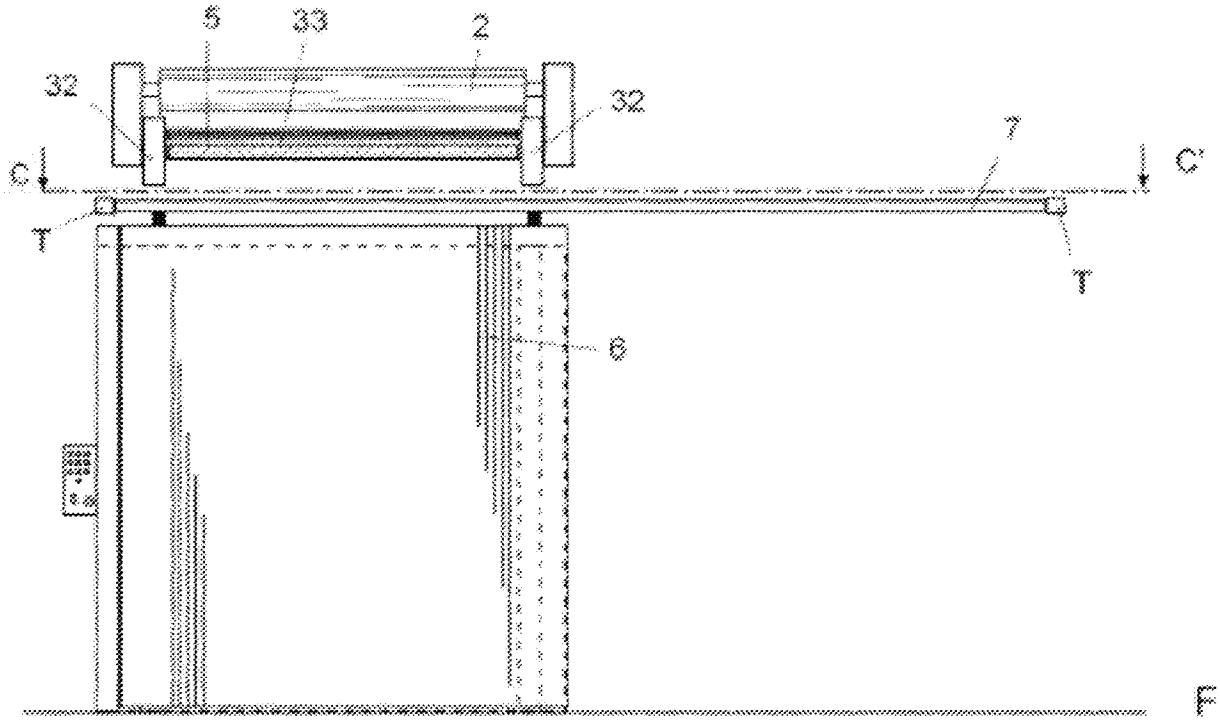
FIG. 7 shows a front view of the closing system of the invention with the quick opening door in an over-opening position and the fire door in the closing position.
Figure 8:
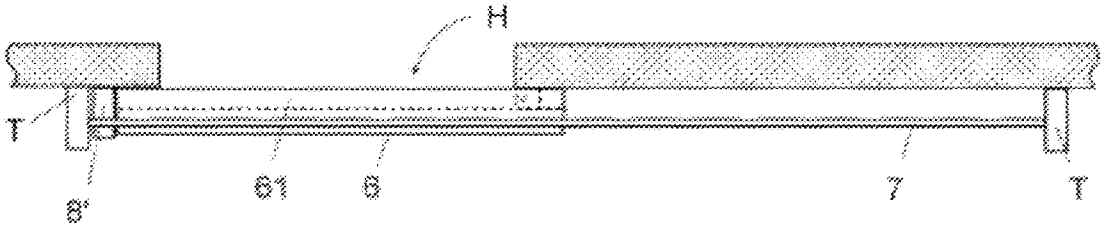
FIG. 8 shows a top view of the system of the invention sectioned along plane E-E', as shown in FIG. 7.

As can be observed in the attached drawings the system comprises, in combination with the quick opening door, a fire door (6) capable of moving lengthwise on a horizontal guide (7) between an opening position shown in FIGS. 1 and 2 and a closing position shown in FIGS. 7 and 8, said fire door (6) having in its top area a side extension (61) directed to the wall or surface in which the through opening (H) is defined. Said horizontal guide (7) is secured by different points (T) to the wall or surface in which the through opening (H) is defined.

The fire door (6) performs its closing action against a closing surface comprising at least two vertical struts (8) on the external sides of the frame (3) of the quick opening door. In this closing position the side extension (61) defined in the upper part of the fire door has to establish a closing action above the lower part (31) of the vertical guides (3) for the quick opening door.

Figure 4:
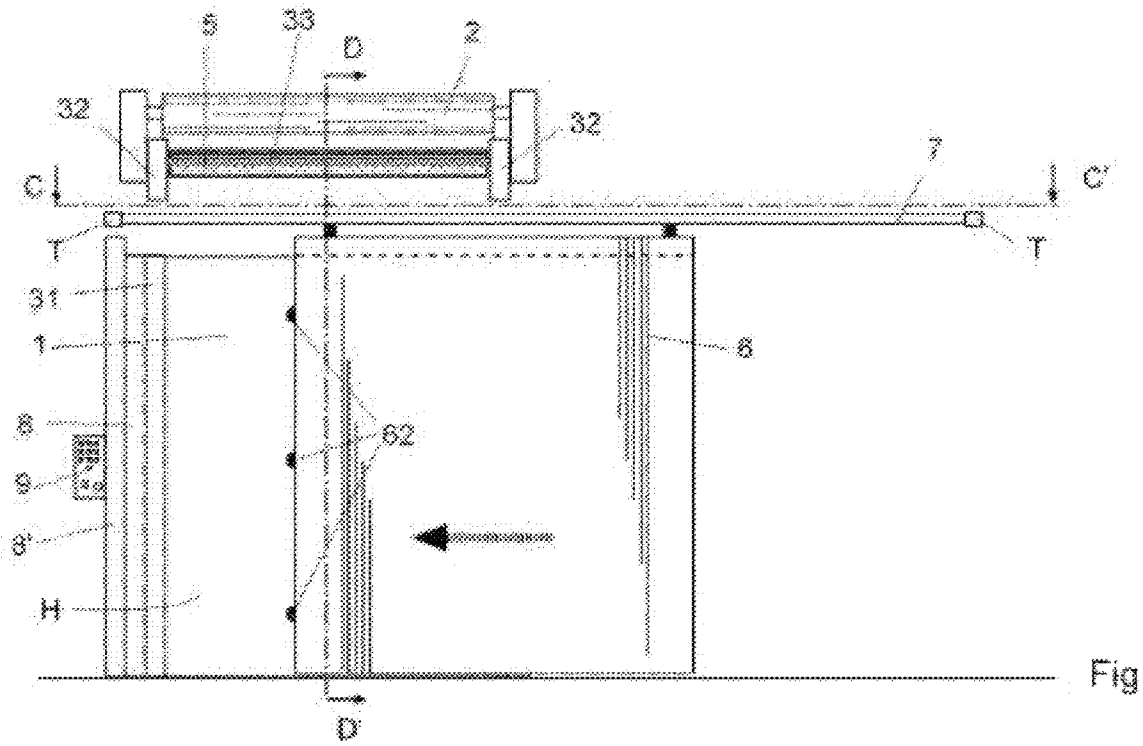
FIG. 4 shows an elevation view of the closing system shown in the previous figures, at the beginning of the emergency actuation, in which the quick opening door is arranged in an over-opening position, hauling the upper part or the vertical guides toward the upper area, showing as well the fire door during its movement towards its closing position.
Figure 5:
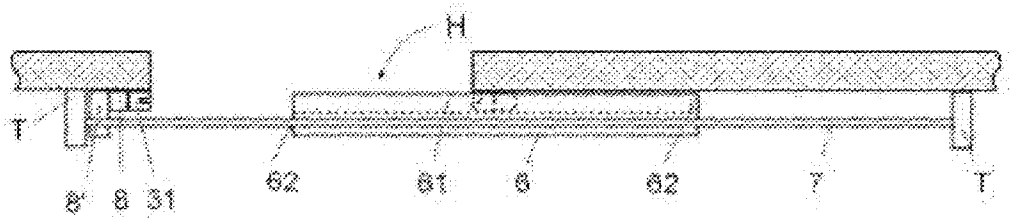
FIG. 5 shows a top view of the system sectioned along the plane C-C' as shown in FIG. 4.
Figure 6:
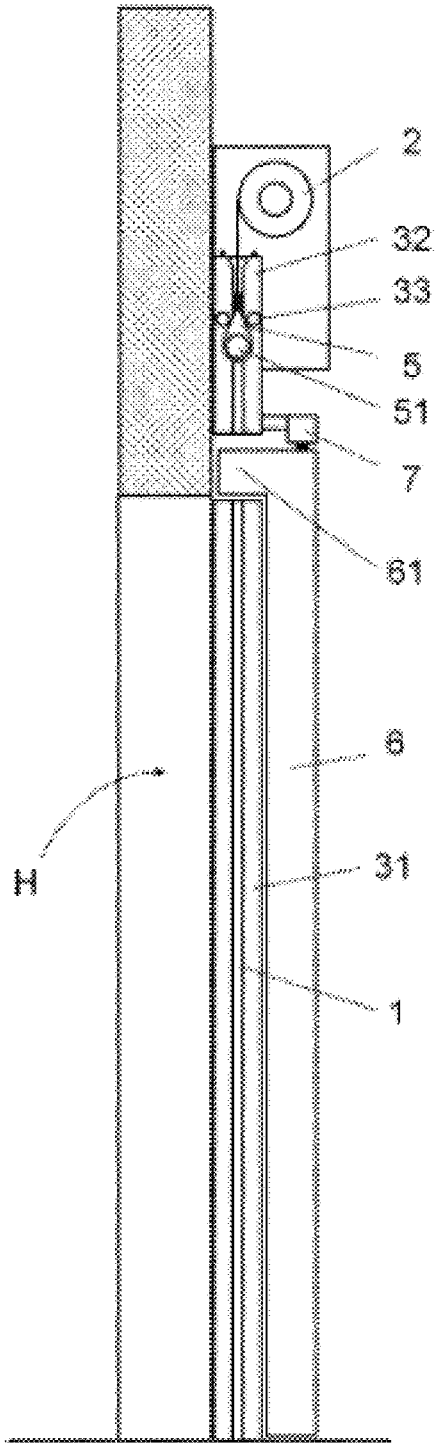
FIG. 6 shows a side elevation view of the closing system sectioned along vertical plane D-D', as shown in FIG. 4.

To this end and in order that the side extension (61) of the fire door does not collide against the upper part of the vertical guides (32) of the quick opening door on occasion of an emergency actuation in case of a fire warning, the quick opening door carries out an over-opening, raising its lower end above the through opening (H); in this way, the bag (5) secured to the lower end of the flexible panel acts on the abutment elements (33) moving the upper part (32) of the vertical guides (3) towards the upper area as shown in FIGS. 4, 6 and 7, and defining between the upper part (32) and the lower part (31) of the guides (3) a sufficiently ample passage in order that the fire door (5) can move to the closing position as shown in FIGS. 4, 5 and 6 establishing the closing with the side extension (61) above the through opening door as shown in FIGS. 7 and 8, without said side extension interfering with the upper part (32) of the vertical guides or with any other element of the quick opening door.

Figure 9:
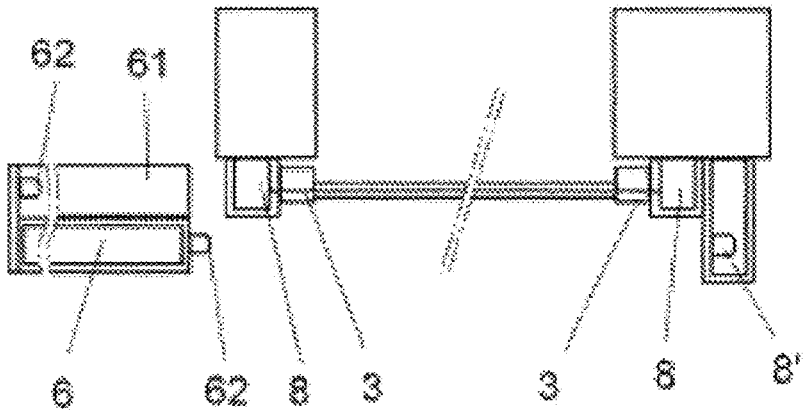
FIG. 9 shows a detail top view of the system of the invention with the fire door in the opening position.
Figure 10:
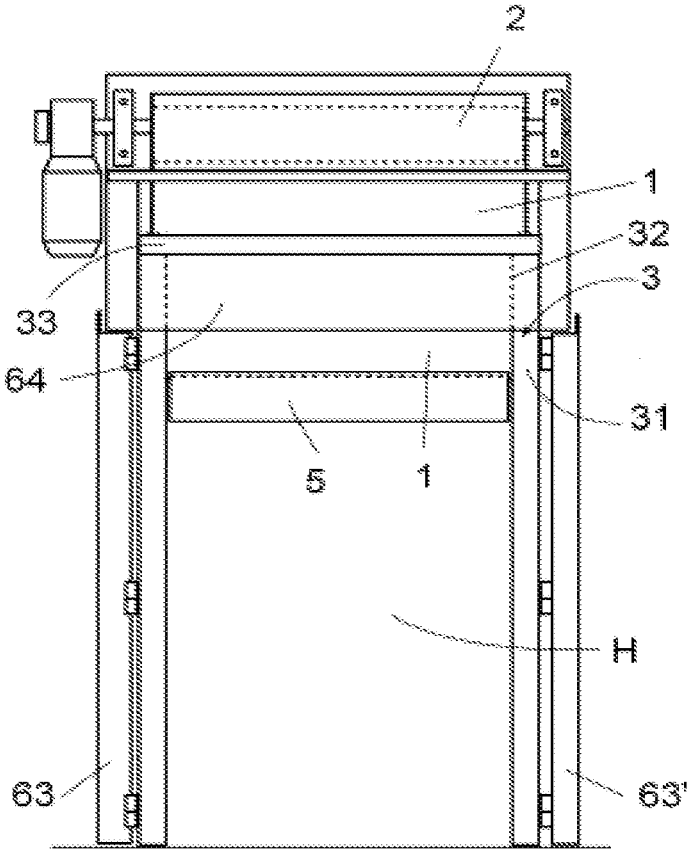
FIG. 10 shows a front view of a variant of the system of the invention with a two leaves swiveling fire door instead of the sliding fire door, with the fire door leaves in open position.
Figure 11:
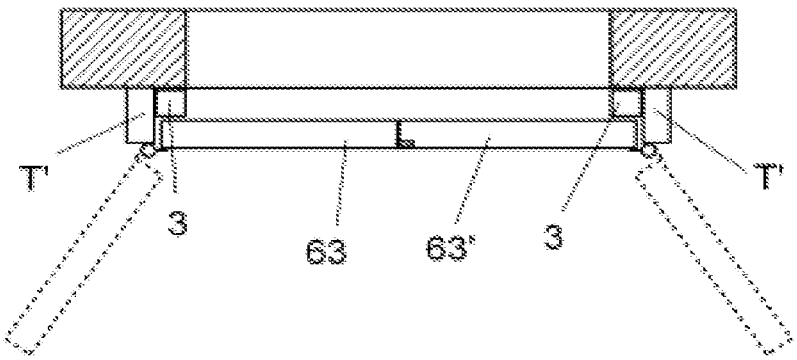
FIG. 11 shows a top view of the variant of the invention shown in FIG. 10, showing in this case, the leaves of the swiveling fire door in its closed position.

As shown in FIG. 9, the fire door (6) has in its vertical frame a plurality of abutments elements (62) aimed at blocking the door in the closing position against the flameguard (8') in one of its sides and against a vertical strut (8) in another of its sides. Said abutment elements enhance the stability of the closing of the fire door (6) in case of fire or explosion.

The system has actuating means (9) connected to a fire warning system (not shown) which means are scheduled to carry out a normal actuation of the quick opening door up to the maximum height of the through opening, keeping the fire door open; or carrying out alternately an emergency actuation to provoke the over-opening of the quick opening door and the closing of the fire door.

In the variant which has been shown in FIGS. 10 to 13 it has been provided the fire door (6) of the system to be mounted in a swiveling way instead of a sliding way, so that the proposed solutions can be adapted to places where no sufficient space is available to locate the fire door, as may be a corridor, because no side spaces exist to permit the opening of the fire door.

In case of needing such a version, the structure of the quick opening door (3) will be still subdivided in a lower portion (31) and an upper portion (32) which serve as guide for the flexible panel (1) of the quick opening door and, in case of a warning signal being received by the actuation means (9), provokes the flexible panel (1) of the quick opening door to carry out an ascent movement acting against the abutments (33), displacing the upper portion (32) of the vertical guides (3) toward the upper area.

In said version, the fire door of the original embodiment (6) is formed by one or two leaves (63, 63'), which function is to close the through opening (H) in case of fire, overlapping one of the leaves on the other leave in case of two leaves, or swiveling only in one of the swiveling points (T').

Figure 13:
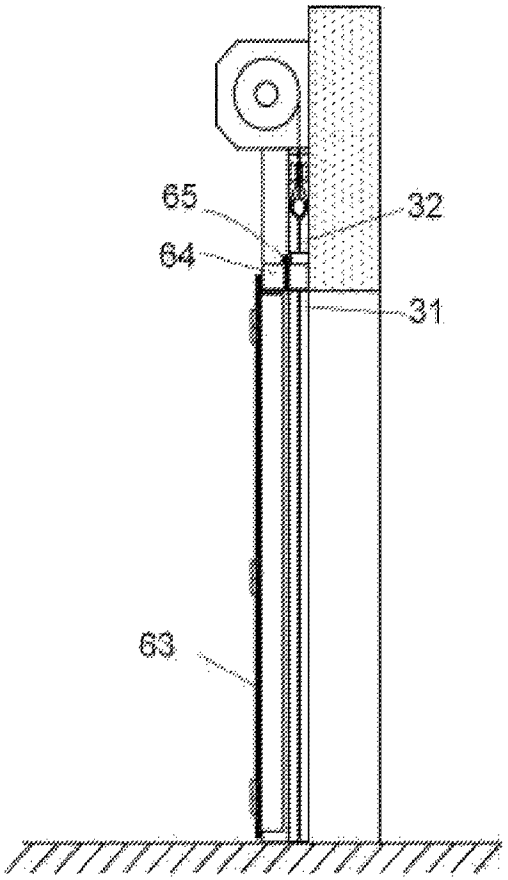
FIG. 13 shows a side view of the variant shown in FIG. 10 with the swiveling leaves of the fire door in closed position.
Figure 12:
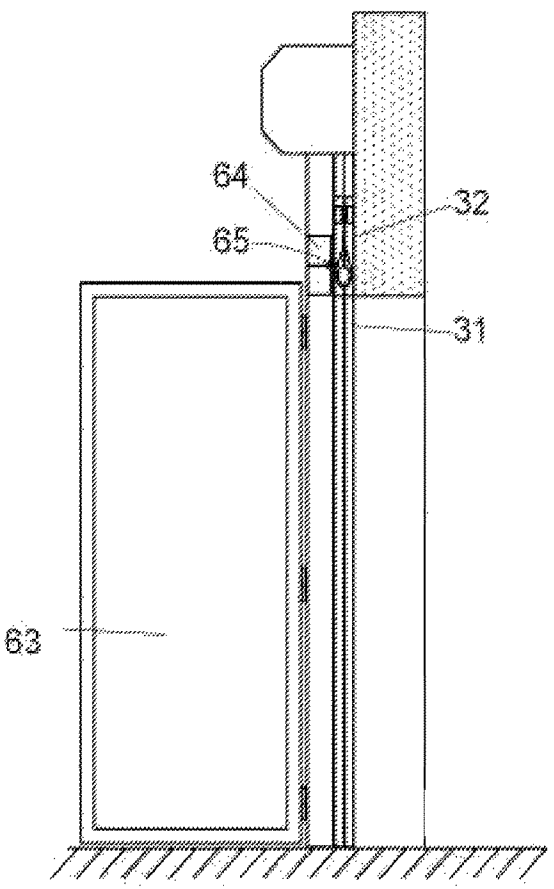
FIG. 12 shows a side elevation view of the variant of the system of FIG. 10 with the swiveling leaves of the fire door in open position.

In said version, the part (61) attached to the fire door (6) may be substituted by a swiveling part (64) with the suitable size that in case of a warning signal and at the same time the flexible panel (1) of the quick opening door is running upwards towards the over-opening position by the action of said warning signal, displacing the upper portion (32) of the vertical guides (3) towards the upper area, swivels on a shaft or hinge (65) under the action of the over-opening movement of the upper portion (32) of the vertical guides (3), so that, said swiveling part (64) switches from a vertical position to a horizontal position as can be seen in FIG. 13, covering in this way the upper part of the through opening (H) and acting in its turn as closing upper frame for the swiveling leaves (63, 63') of the fire door.

After having sufficiently described the nature of the invention, as well as a preferred embodiment of the same, it is stated to all effects that the materials, shape, size and arrangement of the described elements can be modified, whenever the changes do not mean the alteration of the essential characteristics of the invention, which is claimed as follows.

The invention claimed is:

1. A closing system for through openings, comprising:

a quick opening vertically moveable flexible panel (1), connected to an actuating motor driven drum (2);

a pair of vertical guides (3) secured to a wall or surface in which a through opening (H) is defined, said flexible panel (1) being assembled on said vertical guides (3), the vertical guides (3) including respective fixed lower parts (31) covering a height of the through opening (H) and respective mobile upper parts (32) located above the through opening (H), said mobile upper parts (32) being vertically moveable between a lower position, in which the mobile upper parts (32) are adjacent to the fixed lower parts (31), and an upper position, in which a gap is provided between the mobile upper parts (32) and the fixed lower parts (31);

a bag (5) fixed to a lower end of the flexible panel (1), said bag (5) being thicker than the flexible panel (1);

abutments (33) secured to the mobile upper parts (32) of the vertical guides (3);

a fire door (6) movable on a horizontal guide (7) between an opening position, in which the fire door (6) is laterally offset in respect to the through opening (H) and keeps clear the through opening (H), and a closing position, in which the fire door (6) closes the through opening (H), wherein the fire door (6) is a slidable fire door; and a closing element which is moved by the fire door (6) to a closed position in which said closing element is arranged in said gap between the fixed lower parts (31) and the mobile upper parts (32) of the vertical guides (3) closing a space comprised between the wall and the fire door (6) at an upper part of the through opening (H) when the mobile upper parts (32) are in said upper position and the fire door (6) is in said closing position;

wherein the bag (5) engaging said abutments (33) and hauling the upper parts (32) of the vertical guides (3) towards said upper position as a result of an over-opening of the flexible panel (1) by which said lower end of the flexible panel (1) is raised above the through opening (H) in combination with closure of the fire door (6), said over-opening being produced on occasion of an emergency actuation.

2. The closing system according to claim 1, further comprising a motor driving said motor driven drum (2), said motor being connected to a fire warning system scheduled to perform a normal actuation of the quick opening flexible panel (1) up to a maximum height of the through opening (H) while the fire door (6) is kept open, or alternatively said emergency actuation provoking the over-opening of the quick opening flexible panel (1) in combination with closure of the fire door (6).

3. The closing system according to claim 1, wherein said closing element is a side extension (61) defined in an upper part of the fire door (6), said side extension (61) being directed towards the wall or surface in which the through opening (H) is defined, said side extension (61) being laterally housed within said gap provided between the fixed lower parts (31) and the mobile upper parts (32) of the vertical guides (3) when said fire door (6) is arranged in the closing position.

4. The closing system according to claim 3, further comprising two vertical struts (8) arranged at external sides of a frame of the quick opening flexible panel (1), said vertical struts (8) delimitating a closing surface for the fire door (6).

5. The closing system according to claim 3, wherein the fire door (6) has one or more abutments (62) blocking the fire door (6) in a closing position against a flameguard (8') in one side of the fire door (6) and against a vertical strut (8) in another side of the fire door (6).

6. A closing system for through openings, comprising:

a quick opening vertically moveable flexible panel (1), connected to an actuating motor driven drum (2);

a pair of vertical guides (3) secured to a wall or surface in which a through opening (H) is defined, said flexible panel (1) being assembled on said vertical guides (3), the vertical guides (3) including respective fixed lower parts (31) covering a height of the through opening (H) and respective mobile upper parts (32) located above the through opening (H), said mobile upper parts (32) being vertically moveable between a lower position, in which the mobile upper parts (32) are adjacent to the fixed lower parts (31), and an upper position, in which a gap is provided between the mobile upper parts (32) and the fixed lower parts (31);

a bag (5) fixed to a lower end of the flexible panel (1), said bag (5) being thicker than the flexible panel (1);

abutments (33) secured to the mobile upper parts (32) of the vertical guides (3);

a fire door (6), wherein the fire door (6) is a swiveling door having one or two leaves (63, 63') swiveling on struts (T') secured to each of the vertical guides (3) of the quick opening flexible panel (1) between an opening position, in which the fire door (6) keeps clear the through opening (H), and a closing position, in which the fire door (6) closes the through opening (H); and a closing element which is moved by the flexible panel (1) to a closed position in which said closing element is arranged in said gap between the fixed lower parts (31) and the mobile upper parts (32) of the vertical guides (3) closing a space comprised between the wall and the fire door (6) at an upper part of the through opening (H) when the mobile upper parts (32) are in said upper position and the fire door (6) is in said closing position;

wherein the bag (5) engaging said abutments (33) and hauling the upper parts (32) of the vertical guides (3) towards said upper position as a result of an over-opening of the flexible panel (1) by which said lower end of the flexible panel (1) is raised above the through opening (H) in combination with closure of the fire door (6), said over-opening being produced on occasion of an emergency actuation.

7. The closing system according to claim 6, wherein said closing element is a swiveling part (64) comprised in the mobile upper parts (32) of the vertical guides (3) and mounted on a horizontal shaft or hinge (65), said swiveling part (64) swiveling about said shaft or hinge (65) under the action of the over-opening movement of the movable upper parts (32) of the vertical guides (3) between a non-operating vertical position, and an operative horizontal position in which said swiveling part (64) closes a space comprised between the wall and the one or two leaves (63, 63') of the fire door (6) on an upper part of the through opening (H) when said fire door is arranged in the closing position.

8. The closing system according to claim 6, further comprising a motor driving said motor driven drum (2), said motor being connected to a fire warning system scheduled to perform, a normal actuation of the quick opening flexible panel (1) up to a maximum height of the through opening (H) while the fire door (6) is kept open, or alternatively said emergency actuation provoking the over-opening of the quick opening flexible panel (1) in combination with closure of the fire door (6).

* * * * *